US011832718B2

(12) United States Patent
Foley

(10) Patent No.: US 11,832,718 B2
(45) Date of Patent: Dec. 5, 2023

(54) TRIPLE PLANK PLATFORM

(71) Applicant: Tricam Industries, Inc., Eden Prairie, MN (US)

(72) Inventor: Joseph P. Foley, St. Paul, MN (US)

(73) Assignee: Tricam Industries, Inc., Eden Prairie, MN (US)

( * ) Notice: Subject to any disclaimer, the term of this patent is extended or adjusted under 35 U.S.C. 154(b) by 0 days.

(21) Appl. No.: 17/542,132

(22) Filed: Dec. 3, 2021

(65) Prior Publication Data

US 2022/0175129 A1 Jun. 9, 2022

Related U.S. Application Data

(60) Provisional application No. 63/120,794, filed on Dec. 3, 2020.

(51) Int. Cl.
*A47B 1/10* (2006.01)

(52) U.S. Cl.
CPC ..... *A47B 1/10* (2013.01)

(58) Field of Classification Search
CPC ..... E04G 2001/157; B25H 1/04; A47B 1/10; A47B 1/05; A47B 1/04
See application file for complete search history.

(56) References Cited

U.S. PATENT DOCUMENTS 812,301 A * 2/1906 Schwedt ..... E04G 1/152 108/65
982,905 A * 1/1911 Tilley ..... E04G 1/152 182/223
1,312,994 A * 8/1919 Leonard ..... E04G 1/30 108/65
1,474,250 A * 11/1923 Folliard ..... E04G 1/30 248/172
1,774,268 A * 8/1930 Harding ..... E04G 1/152 108/65
2,888,305 A * 5/1959 Perry ..... A47C 11/00 108/65
3,703,220 A * 11/1972 Williams ..... E04G 1/152 182/223
4,121,690 A * 10/1978 Rawlings ..... E04G 3/26 182/45
4,768,620 A * 9/1988 South ..... E04G 1/152 108/65
4,844,200 A * 7/1989 Flint, Jr. ..... E04G 1/152 182/18
5,067,589 A * 11/1991 Bartnicki ..... E04G 1/152 182/119
7,086,500 B2 * 8/2006 Moss ..... E06C 7/16 182/119
7,090,053 B2 * 8/2006 Bothwell ..... E04G 1/152 182/222
8,042,653 B2 10/2011 Grebinoski et al.
8,186,480 B1 * 5/2012 Yoakum, Jr. ..... E06C 1/39 182/123
9,752,334 B2 9/2017 Foley et al.
10,801,219 B2 * 10/2020 Parker ..... E04G 1/30
11,162,267 B1 * 11/2021 Santini ..... E04G 5/08
2006/0169539 A1 * 8/2006 Grebinoski ..... E04G 1/15 182/223

* cited by examiner

*Primary Examiner* — Daniel J Rohrhoff

(57) ABSTRACT

A telescoping work platform utilizing three planks that are slidable to each other allows for a longer maximum length for use while providing for a shorter collapsed length for storage all while providing necessary structural support.

20 Claims, 10 Drawing Sheets

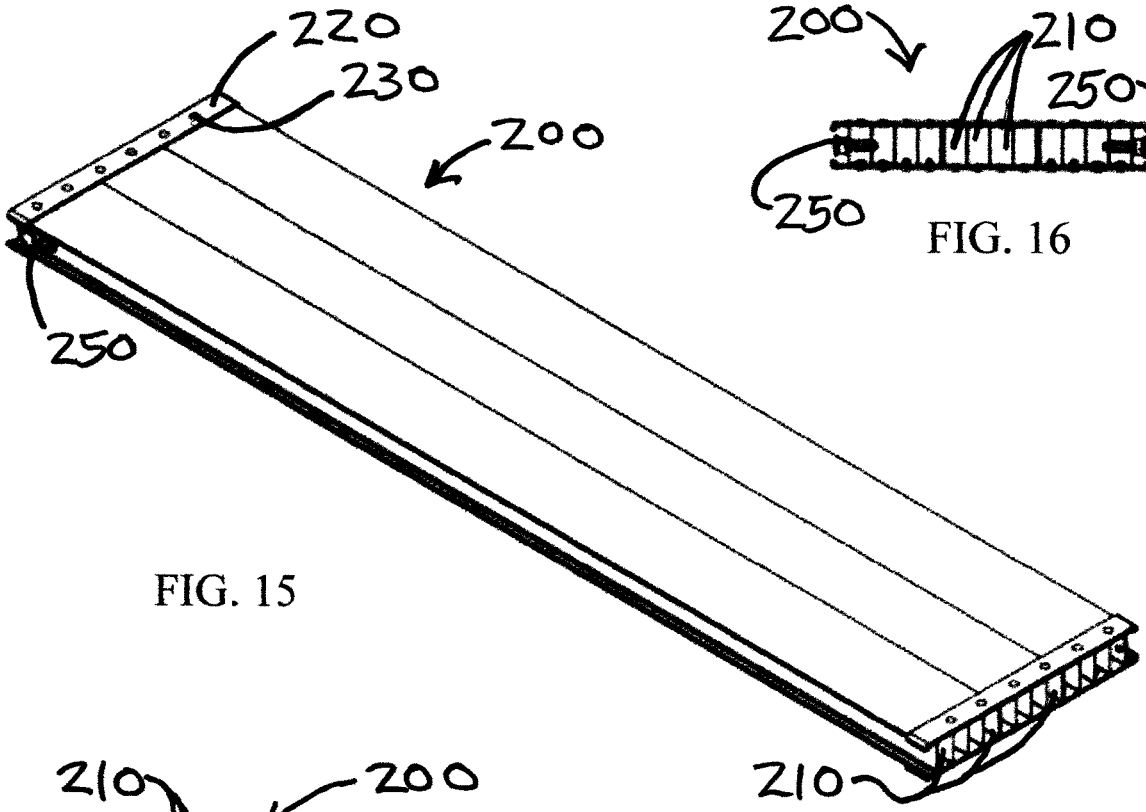
FIG. 15
FIG. 16
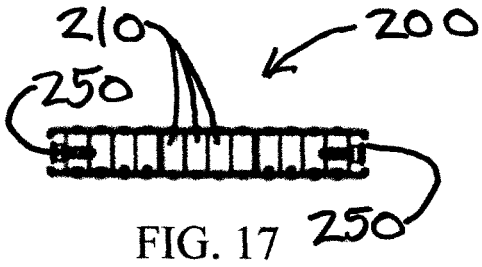
FIG. 17
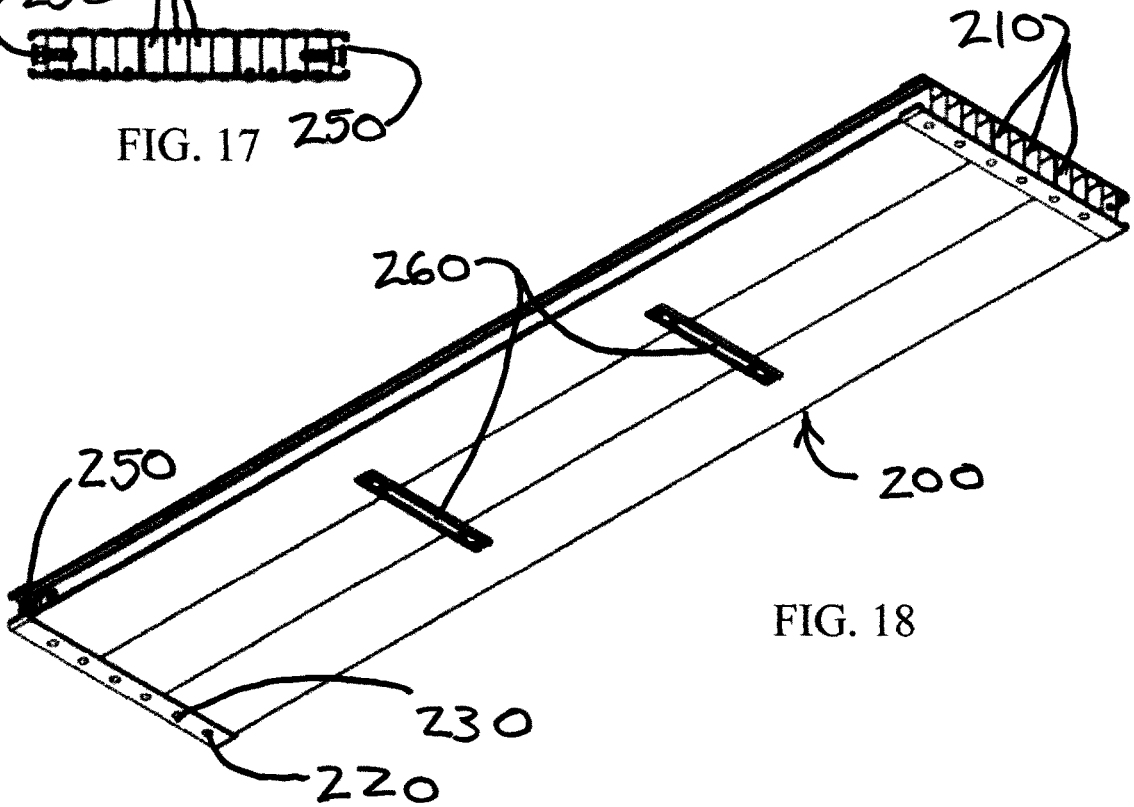
FIG. 18

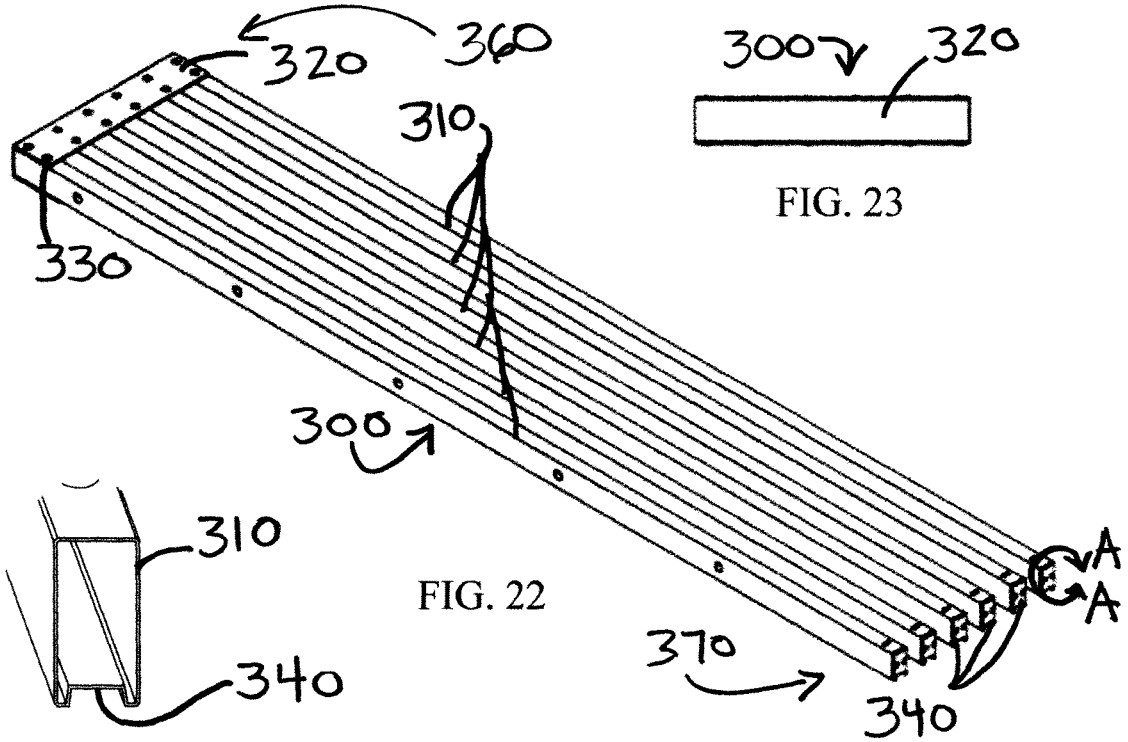
FIG. 22
FIG. 23
FIG. 23a
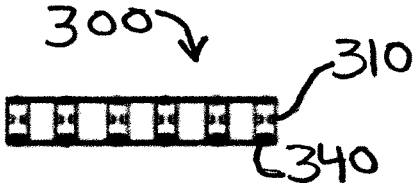
FIG. 24
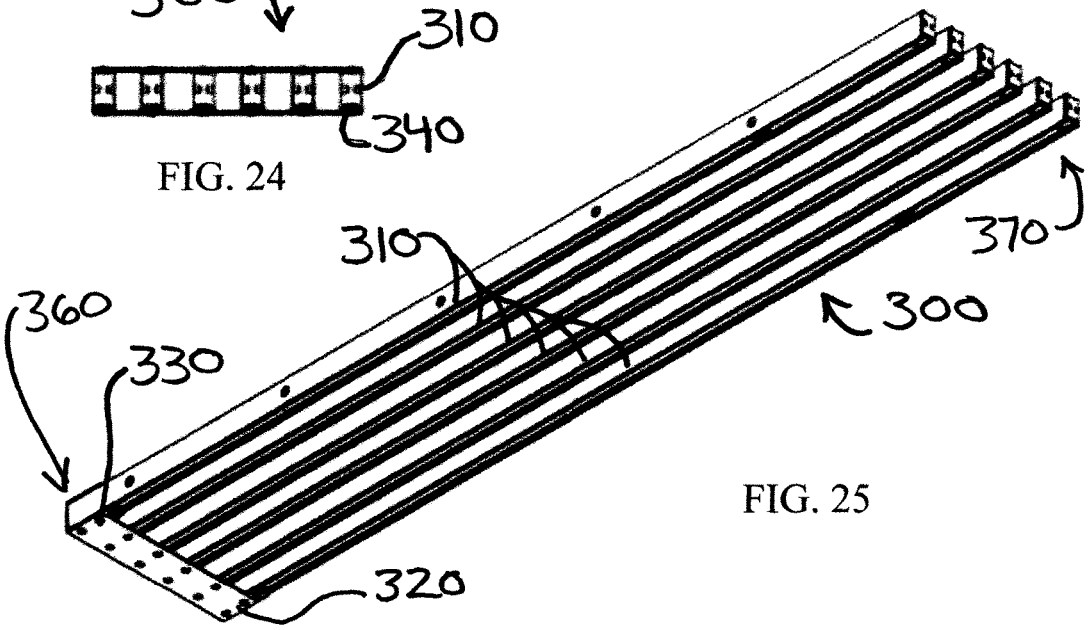
FIG. 25

TRIPLE PLANK PLATFORM

RELATED APPLICATION

The present application claims the benefit of U.S. Provisional Application No. 63/120,794, filed Dec. 3, 2021, which is hereby incorporated herein in its entirety by reference.

TECHNICAL FIELD

The present disclosure relates generally to portable work platforms, and more particularly to a telescoping platform configured to provide a stable work surface that can be collapsed to a length of approximately one third of its maximum length.

BACKGROUND

Professional tradespersons such as painters, drywall installers, and electricians require an elevated work surface upon which to stand to reach the location of their work. Homeowners, too, have the need for elevated platforms for various home improvement projects. Ladders and step stools are inconvenient because they have a narrow width and require continued movement to work on an area of more than a couple feet in length. Therefore, many tradespersons and homeowners use a work platform to provide elevation with extended length.

Work platforms and scaffolds are well known in the art. More recent improvements allow for increased portability and storage. One example of such a work platform is disclosed in U.S. Pat. No. 9,752,334 (assigned to Tricam Industries, Inc.), the contents of which are incorporated by reference herein. Such foldable work platforms present a significant advantage over work platforms and scaffolds of conventional designs, in that they provide superior stability and load bearing, while being easy to transform from a use configuration to a storage configuration (and vice versa) for ease in storage and portability.

Foldable work platforms have the disadvantage of being limited in height at which the platform surface can be placed. In situations where greater height is necessitated, a platform can be placed between ladders or other scaffolding as a trestle to provide an elevated work platform that has a length over which a person can stand to perform work. It is beneficial if such a platform can be collapsible to shorten its length for transport and storage.

One example of such a device is disclosed in U.S. Pat. No. 1,312,994 by Alvin Leonard, the contents of which are incorporated by reference herein. The device of Leonard provides for a collapsible trestle of two sets of alternating slats that can slide between each other to allow the trestle to be collapses to approximately half its maximum length. Other examples of extendable telescoping platforms include U.S. Pat. No. 2,888,305 to George W. Perry and U.S. Pat. No. 4,121,690 to Eugene Rawlings et al., both of which are which are incorporated by reference herein. More recently, U.S. Pat. No. 7,086,500 to N. Ryan Moss et al., teaches to telescoping assemblies, each with a plurality of extending members to provide an elevated work surface that can be used between ladders as an elevated support structure. U.S. Pat. No. 8,042,653 to Grebinoski et al. discloses another variation of an adjustable work platform that includes adjustable with ladder sections that can be removed from the ladder sections.

While each of these references teaches the idea of a telescoping work platform, they also have several limitations. First, they all are only collapsible to approximately half their maximum length. Additionally, the arrangements result is more weight/foot of their maximum lengths, making transporting and handling more difficult. Further, this additional weight places a limit on the weight that can be carried on the platforms due to the limitations of the supports used with the platform. The present disclosure addresses these concerns.

SUMMARY

Embodiments of the present disclosure provide an improved platform for use between elevated points (e.g., two ladders) that is adjustable in length and can be collapsed to approximately one third its fully extended length. In one embodiment the platform comprises two outer sections of prongs that fit within channels of a midsection. The prongs of the outer sections slide within alternating channels of the midsection to allow the platform to telescope and extend to approximately three times the length of the platform when it is completely collapsed (i.e., in stored configuration).

The telescoping work platform of the present invention allows for a structurally sound work platform that telescopes to provide a maximum length that is nearly three times the length of the platform when it is completely collapsed while being lighter weight for transport. This is accomplished by having a midsection that has individual channels to accommodate the prongs of the two outer sections (telescoping sections) of the platform. The telescoping sections of the platform are preferably identical in size and profile and can be interchangeable. The preferred embodiment has prongs from each of the telescoping sections alternating channels of midsection. The telescoping work platform allows one or both outer sections to be telescoped for use. Each channel on the midsection accommodates one prong from either telescoping section.

The sizing of the prongs is such that the prongs will slide with little effort within the channels of the midsection, but provide adequate stiffness to the platform when fully explanded.

Preferably, the midsection of the telescoping platform includes reinforcing plates around its ends to provide strength and stiffness to the ends of the midsection and to protect the individual channels from damage. While the preferred embodiment utilizes rivets to attach the plates to the midsection, any means of connection known in the art may be used. To accommodate the rivets on the interior of the midsection, the bottom of the prongs of the outer two sections may be notched to allow the prongs to slide over the rivets during telescoping/collapsing. The reinforcing plates may be two or more plates at each end as shown in the accompanying drawings or could be a single plate that covers the full perimeter of each end of the midsection.

The preferred embodiment also includes end caps on the outer portions of the telescoping sections to connect the prongs, protect the outer ends of the prongs, and provide a surface onto which a user can pull out a telescoping section from the midsection. The end caps in the preferred embodiment are riveted to the prongs of the telescoping section.

Being a work platform for use in standing, it is preferential to have a grooved surface on the tops of the midsection and prongs to provide better traction. Alternatively, or additionally, a material such as grip tape or paint may be added to the top of the midsection or prongs to increase traction. While not shown on the accompanying drawings, stops could be provided on either the midsection or the prongs of the telescoping sections to prevent the telescoping sections from being completely removed from the midsection.

The telescoping work platform is preferably made of aluminum to provide the necessary strength while minimizing weight, but may be made of any materials known in the art to address strength, weight, electrical properties and is sized to fit between the rails of ladders (or other supports) for which it is used.

The above summary is not intended to describe each illustrated embodiment or every implementation of the subject matter hereof. The figures and the detailed description that follow more particularly exemplify various embodiments.

BRIEF DESCRIPTION OF THE DRAWINGS

Subject matter hereof may be more completely understood in consideration of the following detailed description of various embodiments in connection with the accompanying figures, in which:

FIG. 15 is a top perspective view depicting a plank midsection of a triple plank platform in accordance with an embodiment of the disclosure.

FIG. 16 is a right side elevation view depicting the plank midsection of FIG. 15.

FIG. 17 is a left side elevation view depicting the plank midsection of FIG. 15.

FIG. 18 is a bottom perspective view depicting the plank midsection of FIG. 15.

FIG. 22 is a top is a top perspective view depicting an outer plank section of a triple plank platform in accordance with an embodiment of the disclosure.

FIG. 23 is a right side elevation view depicting the outer plank section of FIG. 22.

FIG. 23*a* is a detail view of a prong end of an outer plank indicated by A-A in FIG. 23.

FIG. 24 is a left side elevation view depicting the outer plank section of FIG. 22.

FIG. 25 is a bottom perspective view depicting the outer plank section of FIG. 22.

Figure 1:
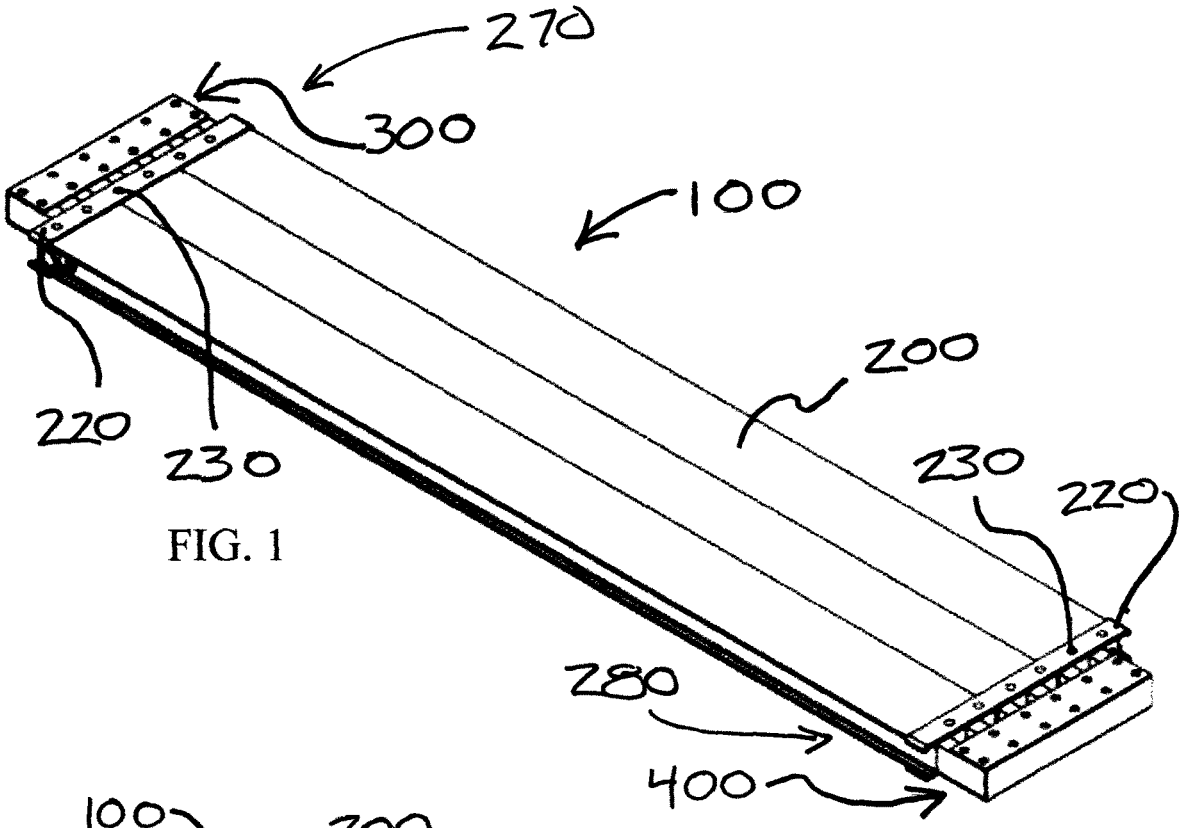
FIG. 1 is a top perspective view depicting a triple plank platform in a collapsed, stored configuration in accordance with an embodiment of the disclosure.
Figure 2:
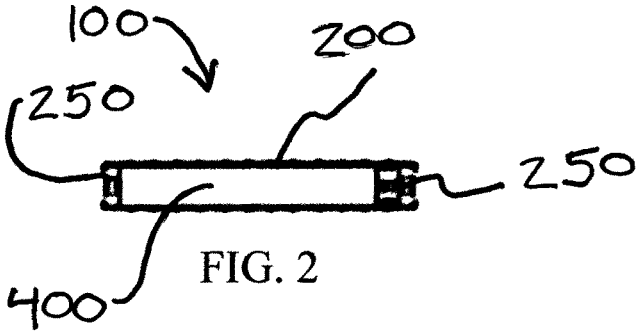
FIG. 2 is a right side elevation view depicting the triple plank platform of FIG. 1.
Figure 3:
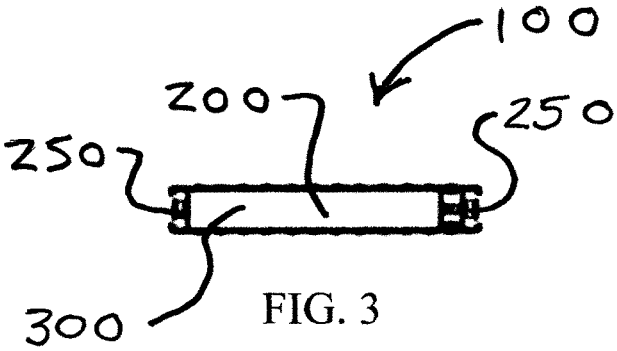
FIG. 3 is a left side elevation view depicting the triple plank platform of FIG. 1.
Figure 4:
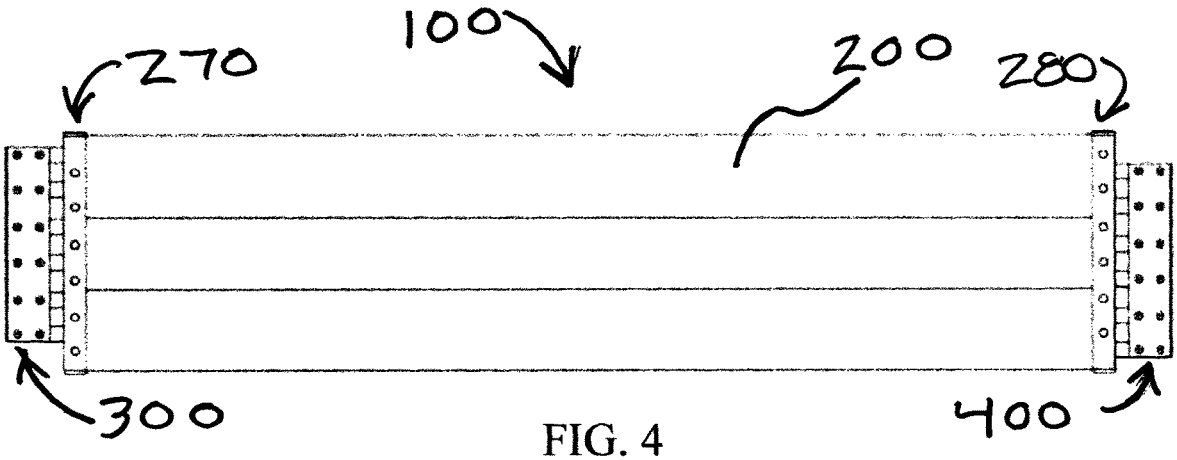
FIG. 4 is a top view depicting the triple plank platform of FIG. 1.
Figure 5:
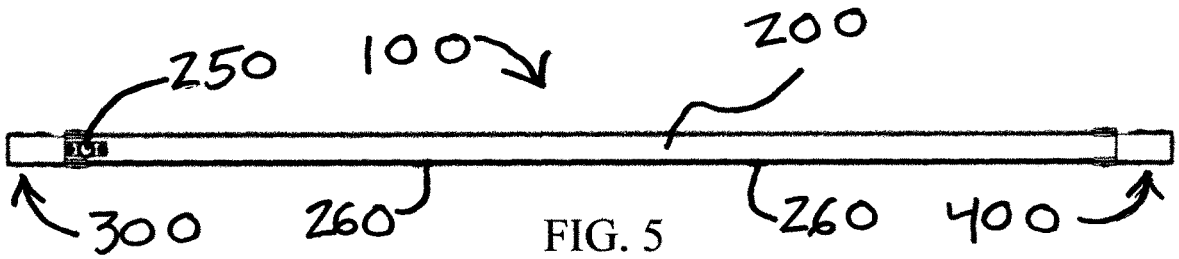
FIG. 5 is a front elevation view depicting the triple plank platform of FIG. 1.
Figure 6:
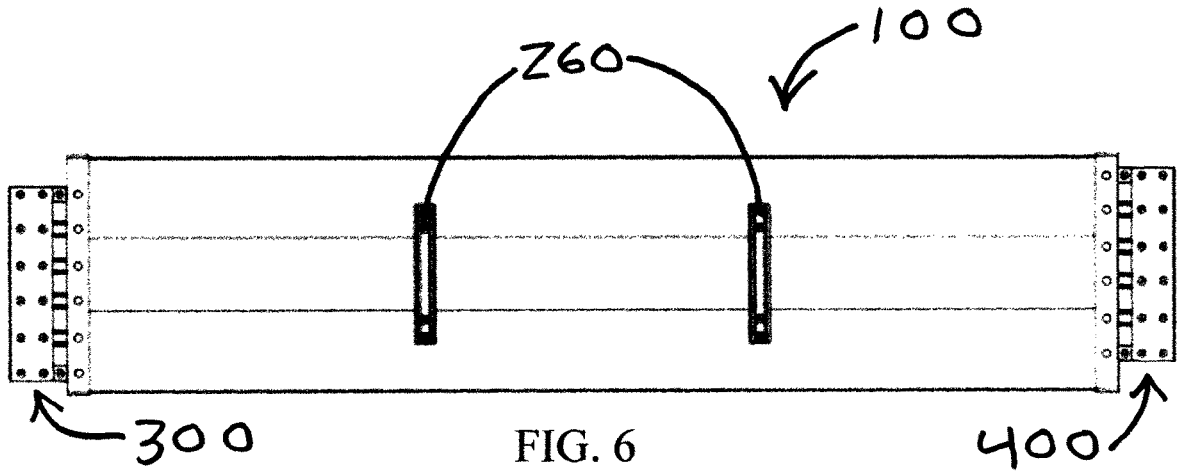
FIG. 6 is a bottom view depicting the triple plank platform of FIG. 1.

While various embodiments are amenable to various modifications and alternative forms, specifics thereof have been shown by way of example in the drawings and will be described in detail. It should be understood, however, that the intention is not to limit the claimed inventions to the particular embodiments described. On the contrary, the intention is to cover all modifications, equivalents, and alternatives falling within the spirit and scope of the subject matter as defined by the claims.

DETAILED DESCRIPTION OF THE DRAWINGS

Figure 7:
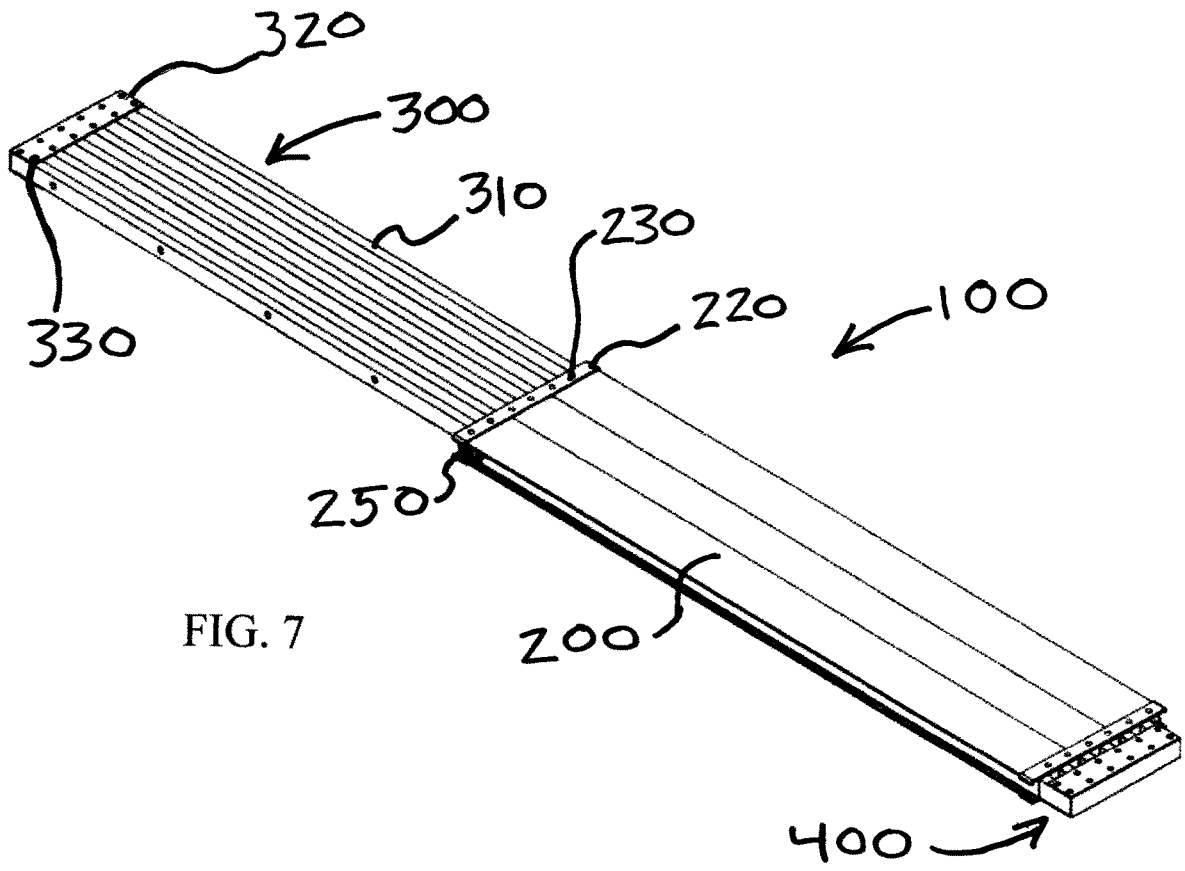
FIG. 7 is a top perspective view depicting a triple plank platform with one of the two outer plank sections extended in accordance with an embodiment of the disclosure.
Figure 8:
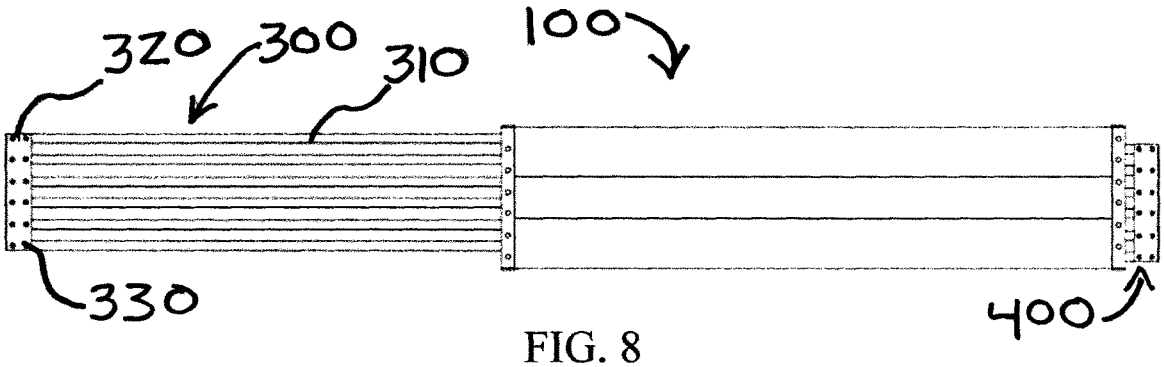
FIG. 8 is a top view depicting the triple plank platform of FIG. 7.
Figure 9:
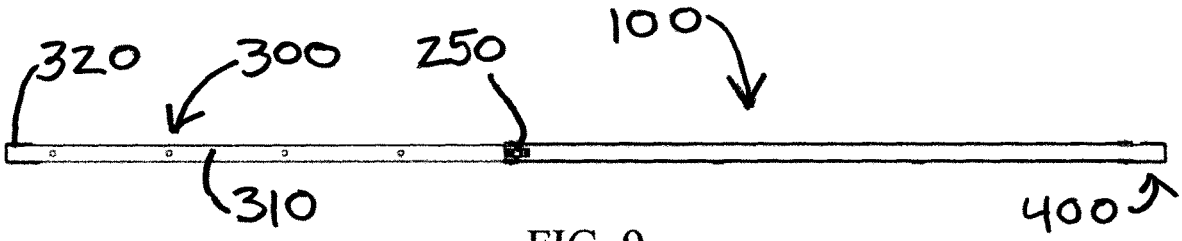
FIG. 9 is a front elevation view depicting the triple plank platform of FIG. 7.
Figure 10:
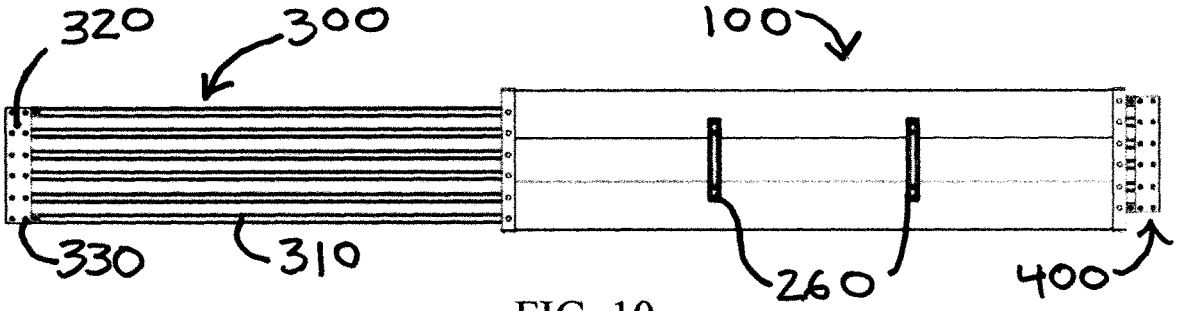
FIG. 10 is a bottom view depicting the triple plank platform of FIG. 7.
Figure 11:
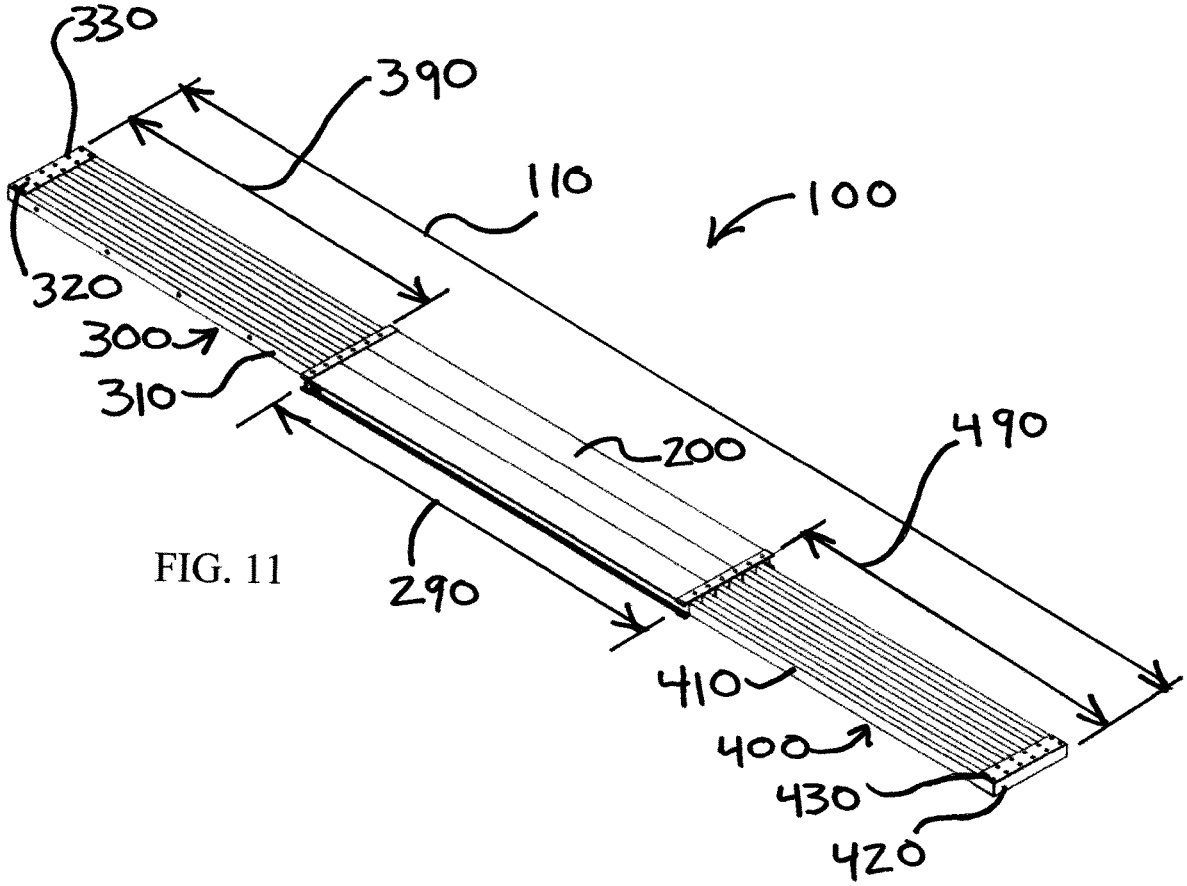
FIG. 11 is a top perspective view depicting a triple plank platform with both outer plank sections extended in accordance with an embodiment of the disclosure (fully extended configuration).
Figure 12:
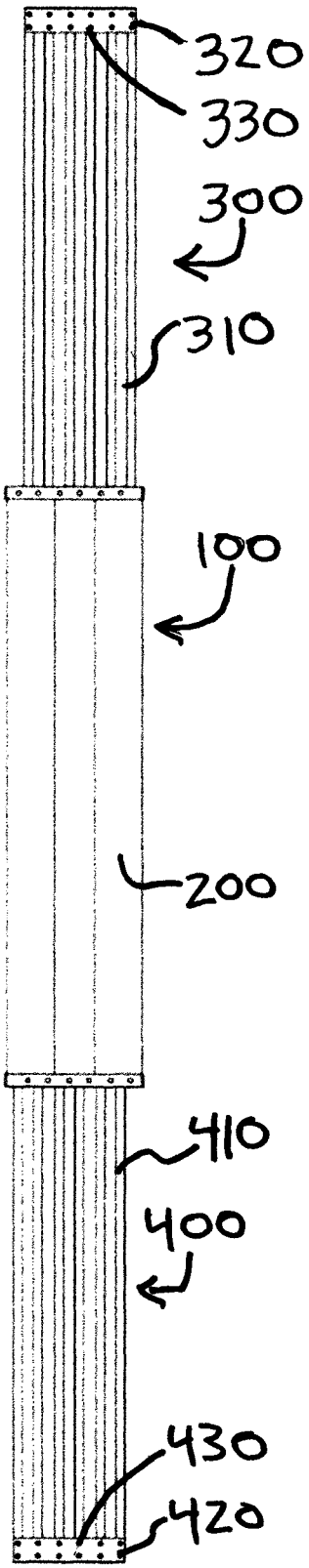
FIG. 12 is a top view depicting the triple plank platform of FIG. 11.
Figure 13:
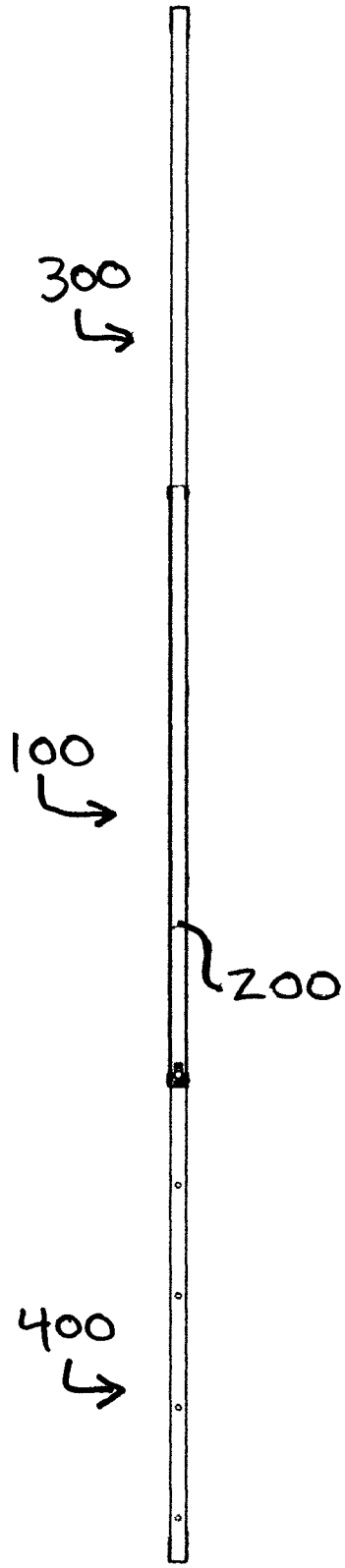
FIG. 13 is a front elevation view depicting the triple plank platform of FIG. 11.
Figure 14:
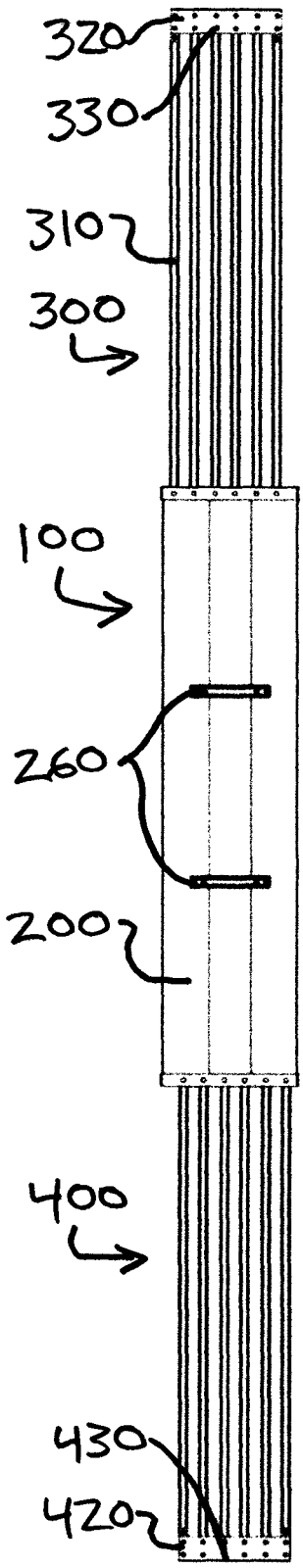
FIG. 14 is a bottom view depicting the triple plank platform of FIG. 11.
Figure 19:
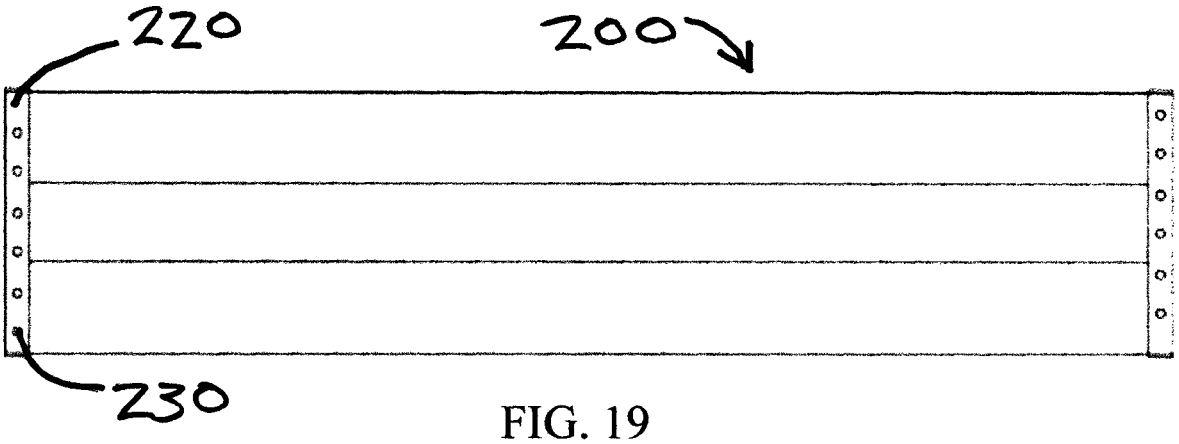
FIG. 19 is a top view depicting the plank midsection of FIG. 15.
Figure 20:
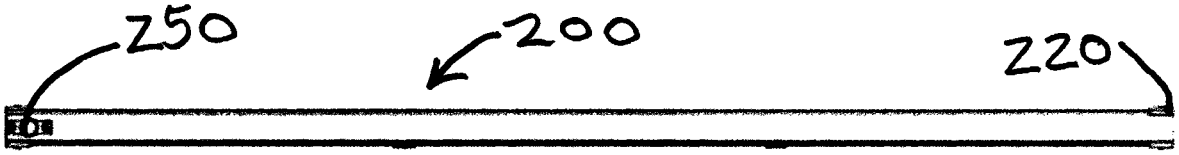
FIG. 20 is a front elevation view depicting the plank midsection of FIG. 15.
Figure 21:
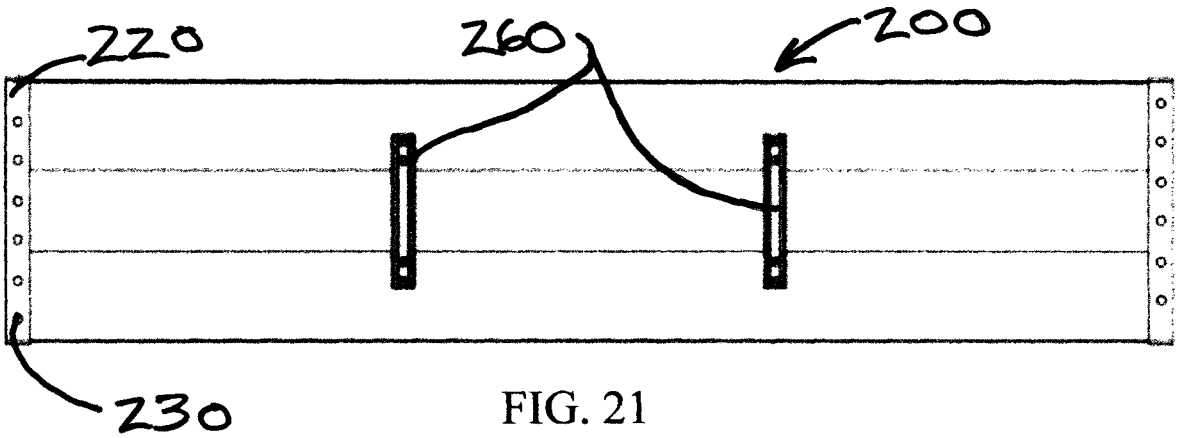
FIG. 21 is a bottom view depicting the plank midsection of FIG. 15.
Figure 26:
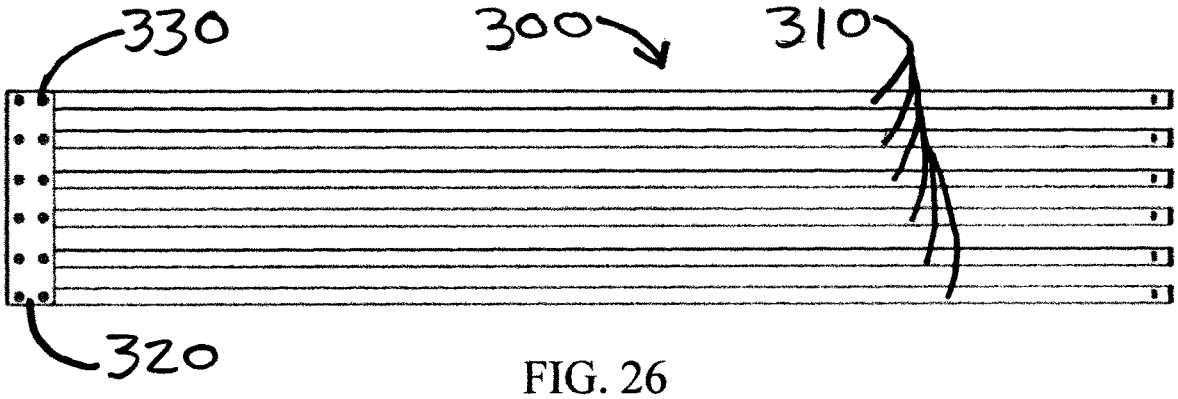
FIG. 26 is a top view depicting the outer plank section of FIG. 22.
Figure 27:
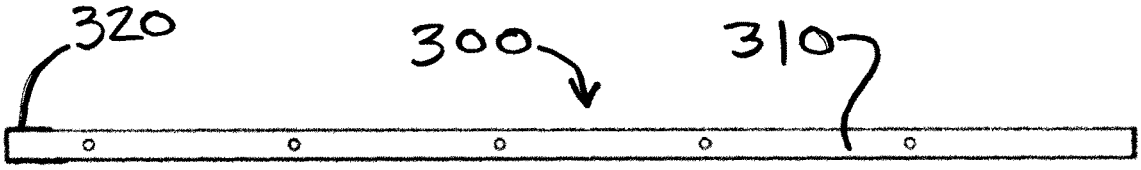
FIG. 27 is a front elevation view depicting the outer plank section of FIG. 22.
Figure 28:
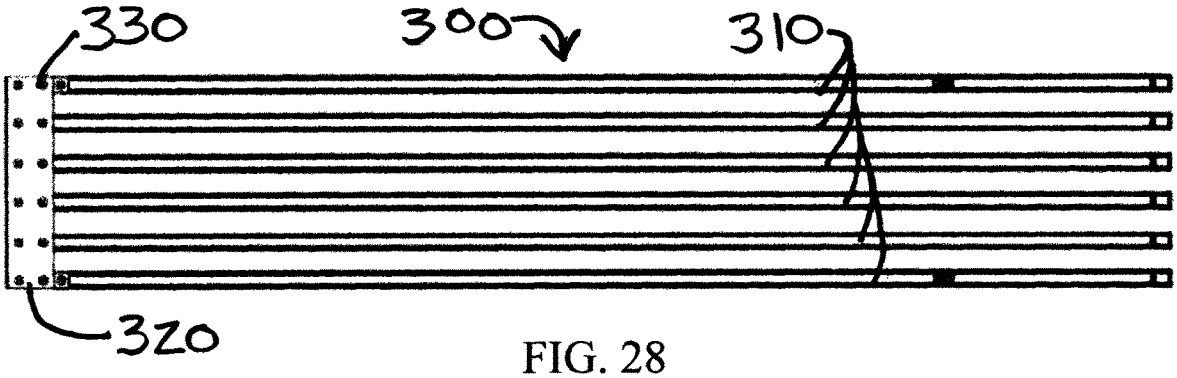
FIG. 28 is a bottom view depicting the outer plank section of FIG. 22.

Referring to FIGS. 1-6, a triple plank platform 100 is depicted in accordance with an embodiment of the disclosure. The triple plank platform 100 preferably has a plank midsection 200 and two outer plank sections 300, 400. \In a preferred embodiment, the outer plank sections 300, 400 are identical and can be used interchangeably at either longitudinal ends 270, 280 of the plank midsection 200. The triple plank platform 100 can be configured in a fully collapsed configuration as depicted in FIG. 1. Each of the outer plank sections 300, 400 can slideably move in relation to the plank midsection 200 to adjust the overall length of the triple plank platform 100 (as depicted in FIGS. 7 and 11) to a fully extended configuration (FIG. 11).

The plank midsection 200 comprises several channels 210 (as seen in FIGS. 15-18) that are sized to accommodate prongs 310 of the outer plank sections 300, 400. The channels 210 and prongs 310 are preferably rectilinear in shape for stiffness and sized to allow the prongs 310 to slide within the channels 210 with little effort, but provide adequate stiffness when the triple plank platform 100 is fully expanded.

Preferably, the plank midsection 200 includes reinforcing plates 220 at its longitudinal ends 270, 280 to provide stiffness and protect the ends of the channels 210. The reinforcing plate 220 can be a single part or multiple pieces as depicted in FIGS. 15-18 and are fastened to the plank midsection 200 by any means known in the art. The preferred embodiment of fastening the reinforcing plates 220 is with rivets 230. The preferred embodiment uses an arrangement of rivets 230 to fasten the reinforcing plates 220 with placement at channels 210 that will not interfere with the top surface of the prongs 310. To accommodate any rivets 230 along the bottom of the plank midsection 200, the prongs 310 may have grooves 340 sized to allow the prongs 310 to slide over the rivets 230 with no contact.

The plank midsection 200 may also include support beams 260 that provide additional stiffness and to fasten multiple parts of plank midsection 200 if so configured. Stops 250 may be located at the longitudinal ends of the plank midsection 200 to prevent plank outer sections 300, 400 from being completely removed from the plank midsection 200. Stops 250 may be any structure known in the art such as a bolt, screw, or a detent. Preferably, stops 250 are removable to allow the plank outer sections 300, 400 to be removed from the plank midsection 200 for cleaning or repair. Alternatively, or in addition to stops 250 on the plank midsection 200, stops may be attached to the prong ends (not shown) to prevent plank outer sections 300, 400 from being completely removed from the plank midsection 200.

Details of the plank outer sections 300, 400 are provided in FIGS. 23-28. Plank outer sections 300, 400 are comprised of prongs 310 sized to slideably fit within the channels 210 of the plank midsection 200. The prongs 310 are connected by an endcap 320 fastened at one of the plank outer section 300, 400 longitudinal ends 360, 370 to provide a gripping area to adjust the length 110 of the triple plank platform 100 and to protect the outer ends of the prongs 310. Endcaps 310 can be fastened to the prongs 310 by any means known in the art, but are preferably fastened by rivets 330. Endcap 320 can be a unitary piece that wraps from the tops to bottom of the prongs 310 as depicted in FIGS. 22 and 25 or may be multiple pieces. The preferred embodiment uses at least two rivets 330 on each side of the endcap 320 to maintain the alignment of the prongs 310. As most clearly seen in FIG. 23*a*, each prong 310 has a groove 340 in its bottom sized to allow the prong 310 to slide over rivets 230 holding the reinforcing plates 220 to the bottom of the plank midsection 200.

The preferred embodiment of the triple plank platform 100 is for prongs 310 on one of the plank outer sections 300, 400 to alternate channels 210 to allow weight placed on the triple plank platform 100 to be distributed evenly between the plank outer sections 300, 400. The preferred embodiment also contemplates the plank outer sections 300, 400 being of similar length 390, 490 as the plank midsection 200 length 290. Such an arrangement allows for the length 110 of the triple plank platform 100 in its fully extended orientation (FIG. 11) to be approximately three times the length 110 of the triple plank platform 100 in its fully collapsed orientation (FIG. 1) or adjustable to any length 110 in between those extremes.

The components of the triple plank platform 100 are preferably made of aluminum to provide both the necessary strength and stiffness which minimizing overall weight. However, the disclosure does contemplate any of the components of the triple plank platform 100 being made of any suitable materials known in the art to provide the necessary characteristics for each component.

Being intended as a work platform to stand upon, it is preferential to have a grooved surface on the tops of the plank midsection 200 and prongs 310 to provide better traction. Alternatively, or additionally, a material such as grip tape or paint may be added to the top of the midsection 200 or prongs 210 to increase traction.

Various embodiments of systems, devices, and methods have been described herein. These embodiments are given only by way of example and are not intended to limit the scope of the claimed inventions. It should be appreciated, moreover, that the various features of the embodiments that have been described may be combined in various ways to produce numerous additional embodiments. Moreover, while various materials, dimensions, shapes, configurations and locations, etc. have been described for use with disclosed embodiments, others besides those disclosed may be utilized without exceeding the scope of the claimed inventions.

Persons of ordinary skill in the relevant arts will recognize that the subject matter hereof may comprise fewer features than illustrated in any individual embodiment described above. The embodiments described herein are not meant to be an exhaustive presentation of the ways in which the various features of the subject matter hereof may be combined. Accordingly, the embodiments are not mutually exclusive combinations of features; rather, the various embodiments can comprise a combination of different individual features selected from different individual embodiments, as understood by persons of ordinary skill in the art. Moreover, elements described with respect to one embodiment can be implemented in other embodiments even when not described in such embodiments unless otherwise noted.

Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims, it is expressly intended that the provisions of 35 U.S.C. § 112(f) are not to be invoked unless the specific terms "means for" or "step for" are recited in a claim.

We claim:

1. A telescoping work platform, comprising:

a plank midsection having two longitudinal ends comprising:

an even number of enclosed rectilinear channels extending uninterrupted between the longitudinal ends; and a reinforcing plate proximate each plank midsection longitudinal end;

two outer plank sections, each outer plank section having two longitudinal ends and comprising:

a number of rectilinear prongs equal to one half the number of rectilinear channels and each rectilinear prong sized to slideably fit within a respective rectilinear channel; and an end cap at least partially covering one of the outer plank section longitudinal ends;

wherein each rectilinear channel is occupied by a single unique rectilinear prong.

2. The telescoping work platform of claim 1 wherein the outer plank sections are equal in length and the plank midsection is approximately the same length as the outer plank sections.

3. The telescoping work platform of claim 1 further comprising a stop associated with each outer plank section to prevent the complete removal of the two outer plank sections from the plank midsection.

4. The telescoping work platform of claim 1 wherein each reinforcing plate is fastened to the plank midsection by rivets.

5. The telescoping work platform of claim 4 wherein each rectilinear prong has a groove to accommodate a rivet.

6. The telescoping work platform of claim 1 wherein each end cap is fastened to its respective outer plank longitudinal ends by rivets.

7. The telescoping work platform of claim 1 wherein the plank midsection is comprised of extruded aluminum.

8. The telescoping work platform of claim 1 wherein the plank midsection comprises two assemblies, each assembly comprising one or more rectilinear channels.

9. The telescoping work platform of claim 1 wherein each outer plank section prong is a unibody construction.

10. The telescoping work platform of claim 1 wherein each outer plank section prong is comprised of extruded aluminum.

11. A telescoping work platform, comprising:

a plank midsection comprising two longitudinal ends and a number of rectilinear walled channels running uninterrupted between the two longitudinal ends;

two outer plank sections, each outer plank section comprising an end cap and a number of rectilinear prongs equal to no more than one half the number of rectilinear channels, each rectilinear prong sized to slideably fit within a respective rectilinear channel; and a reinforcing plate proximate each plank midsection longitudinal end;

wherein each rectilinear channel is occupied by a single unique rectilinear prong.

12. The telescoping work platform of claim 11 wherein the telescoping work platform has a collapsed configuration that is approximately one third the length of its fully extended configuration.

13. The telescoping work platform of claim 11 wherein the outer plank sections are equal in length and the plank midsection is approximately the same length as the outer plank sections.

14. The telescoping work platform of claim 11 wherein the plank midsection comprises two assemblies, each assembly comprising one or more rectilinear channels.

15. The telescoping work platform of claim 11 wherein each outer plank section prong is a unibody construction.

16. The telescoping work platform of claim 11 wherein each outer plank section prong is comprised of extruded aluminum.

17. The telescoping work platform of claim 11 further comprising a stop associated with each outer plank section to prevent the complete removal of the two outer plank sections from the plank midsection.

18. The telescoping work platform of claim 11 wherein the plank midsection is comprised of extruded aluminum.

19. The telescoping work platform of claim 11 wherein each end cap is fastened to its respective rectilinear prongs by rivets and each end cap is fastened to its respective longitudinal end of the plank midsection by rivets.

20. A telescoping work platform, comprising:

a plank midsection comprising two longitudinal ends and a number of circumscribed rectilinear channels extending without interruption between the two longitudinal ends; and two outer plank sections, each outer plank section comprising an end cap and a number of rectilinear prongs equal to less no more than one half the number of rectilinear channels, each rectilinear prong sized to slideably fit within and occupy it own unique respective rectilinear channel.

* * * * *